United States Patent [19]

McKinney

[11] Patent Number: 4,612,681

[45] Date of Patent: Sep. 23, 1986

[54] DRAGLINE SWEEPER

[75] Inventor: P. Jay McKinney, Barberton, Ohio

[73] Assignee: Roadway Express, Inc., Akron, Ohio

[21] Appl. No.: 697,112

[22] Filed: Jan. 31, 1985

[51] Int. Cl.[4] ..... A47L 11/24

[52] U.S. Cl. ..... 15/49 R; 15/1.7

[58] Field of Search ..... 15/49 R, 50 R, 49 C, 15/50 C, 98, 385, 388, 1.7; 51/177

[56] References Cited

U.S. PATENT DOCUMENTS 3,496,681 2/1970 Oswald ..... 15/49 R 3,946,692 3/1976 Sierra et al. ..... 15/49 R

FOREIGN PATENT DOCUMENTS 704919 4/1966 Italy ..... 15/49 R

*Primary Examiner*—Edward L. Roberts

*Attorney, Agent, or Firm*—Oldham, Oldham & Weber Co.

[57] ABSTRACT

Apparatus for cleaning the path of an endless conveyor of its debris comprising providing a wheel-mounted carriage attachable and detachable to the conveyor to drag or drive the carriage to effect rotation of the drive wheels to effect counter-rotation of a pair of brushes to sweep the debris from the path of the endless conveyor.

3 Claims, 5 Drawing Figures

DRAGLINE SWEEPER

TECHNICAL FIELD

This invention relates to a dragline sweeper and related apparatus for cleaning the path of an endless conveyor for carts associated with the floor of a storage area such as a warehouse or loading dock. More particularly, this invention relates to an apparatus for cleaning the path of an endless conveyor for carts wherein the movement of wheels which in turn drive two counter-rotating brushes to clean said path.

BACKGROUND ART

Heretofore in warehouses, loading docks and related shipping and storage areas, it has been customary to use small carts to move freight or goods from one position or one station within the warehouse or storage area to another by such means as trucks and related apparatus. Another common way has been to use what is known as an endless conveyor which is mounted preferably in a recess opening in the floor and as the chain or conveyor moves around in the endless path, carts or related vehicles are fastened to the conveyor by well known means such as a chain having a small skate-like carriage having a recess at the back thereof for engaging a pin that is dropped down into the track from the cart above. Other means such as tongue or fingered members projecting up from the conveyor can also be utilized. As warehouse floors and storage areas tend to become dirty from bursting packages and destruction of goods being moved, as well as dirt flying in from the outside, it has been the customary experience that after a few weeks or a very short time, the conveyor track becomes clogged with debris from the storage area floor. Hence, the conveyor line has to be shut down and be cleaned before it can be operated again. Also, as the carts roll on the floor and they become wet, dirty with grease and grime and the debris tends to accumulate due to something forming like mud and drying on the wheels and the floor. Often, the path in which the carts run becomes extremely rough due to this accumulation; and, if the goods are breakable, they tend to be broken by the jarring for they may not be well packed many times when they are on these carriages, but just sit thereon. Then, the line has to be shut down in order to clean the mud and debris from the floor near the track, especially in the area where the cart wheels run.

DISCLOSURE OF INVENTION

It is therefore an aspect of this invention to provide an apparatus which may be attached to an endless conveyor for carts associated with the floor of a storage area and, as the apparatus moves along with the conveyor, it causes a pair of drive wheels to rotate which in turn rotates a pair of cleaning brushes counter to each other to clean the conveyor path.

In another aspect of this invention, the apparatus of this invention cooperates with a normal endless conveyor in such a manner that as the conveyor operates and debris accumulates on the floor in the vicinity of the path of the endless conveyor, the brushes of the cleaning apparatus moves the dirt and debris back away from the path of the conveyor so that it is not able to clog or stop or block the endless conveyor.

These and other aspects of the invention will become more apparent as the description proceeds of the results achieved by this apparatus for cleaning the path of an endless conveyor and its carts associated with the floor of a storage area, comprising: a wheel-mounted carriage attachable to said conveyor and containing a pair of counter-rotatable cleaning brushes, a pair of drive wheels and a means to attach and detach the carriage to the conveyor, said cleaning brushes being mounted within said carriage and being adjustably loaded by an adjustable load means to contact the floor, said pair of drive wheels being rotated by movement of the carriage to turn a means connected to a means to rotate said brushes.

BRIEF DESCRIPTION OF DRAWINGS

The nature of this invention may be more readily appreciated and understood by reference to the drawings, wherein.

BEST MODE FOR CARRYING OUT THE INVENTION

Figure 1:
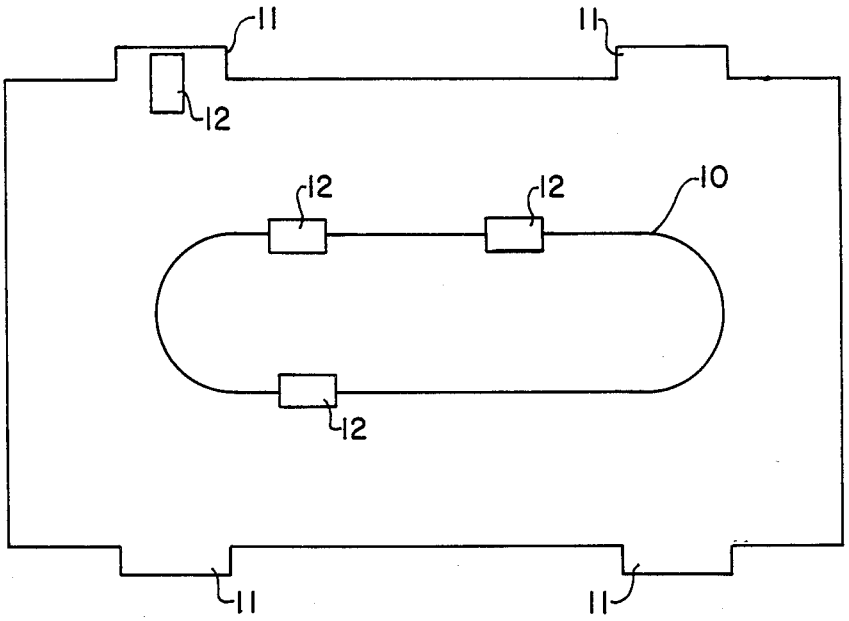
FIG. 1 is a schematic view of a storage area floor showing the track or path in which the endless conveyor moves on said floor or area.

Referring now to FIG. 1 and to the track or conveyor path shown by numeral 10, it will be readily appreciated that as the conveyor with its carts 12 moves around the endless path shown, the carts can be detached from the endless conveyor to leave the cart position in any position, for instance, a cart can be detached from the endless conveyor 10 and pushed or rolled over to loading dock 11 where the cart 12 would be unloaded onto a truck or related conveyance means and then the empty cart would be returned to the conveyor 10 in the customary and usual manner associated with the use of endless conveyor in a loading dock or warehouse area. As these carts move around track 10, there is a path of about 0.3 of a meter to about a meter or more depending on the cart size on each side of the conveyor which collects debris. Also, the conveyor is usually sunken into the floor so vehicles can move across the path without being disturbed by the track. Much debris accumulates along the track and needs to be cleaned or the track will become clogged., The nature of the dragline sweeper of this invention may be more readily appreciated and understood by reference to FIG. 2, wherein numeral 13 designates generally the housing or framework of the cart which may be constructed of any suitable material such as angle iron welded together to give a rectangular cross-braced structure having preferably an expanded aluminum or related metal covering to protect the apparatus from accumulating various materials that might tend to hinder its operation and also as a safety feature. Also, it is desirable to have a box-like structure or top so on top of the housing to hold tools and other equipment needed along the line.

Housing 13 of the wheel-mounted carriage has mounted therein a pair of rotatable driven wheels by means of brackets or wheel mounts 15. The rotatable driven wheels preferably in one embodiment are the rear wheels from a motorized golf cart, which are shown in the plan view of FIG. 2 with the drive shaft 16 thereof projecting upward vertically and terminating in a gear wheel 17 or sprocket which has a chain 18 that passes around it in the manner shown in FIG. 2. This chain 18 in turn passes around a right and left sprocket or a gear, 19 and 20 respectively, associated with a pair of rotatable cleaning brushes 21 and 22.

Figure 2:
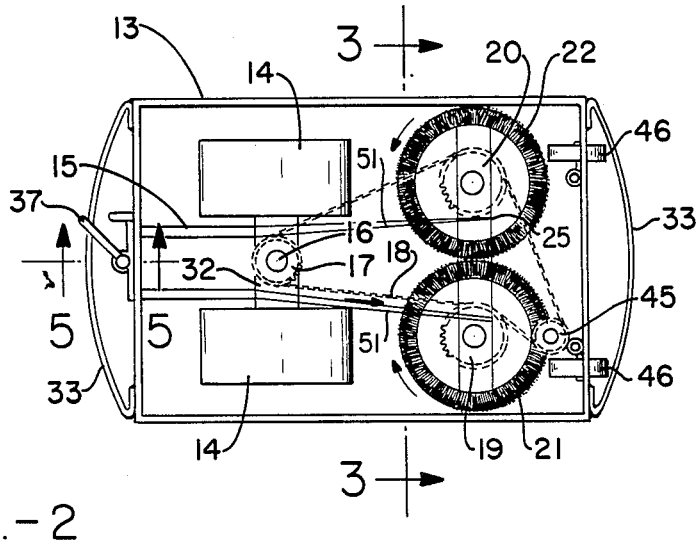
FIG. 2 is a plan view of the wheel-mounted carriage that can be readily attached to the conveyor.
Figure 3:
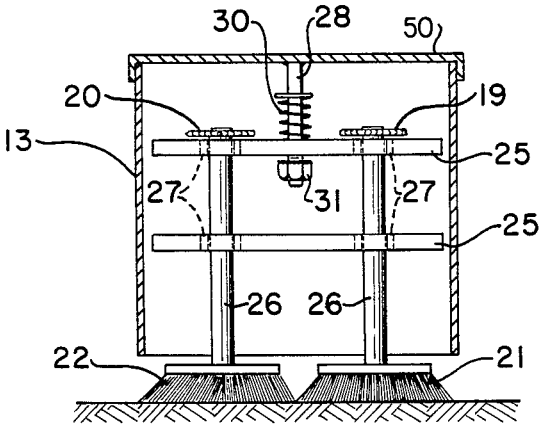
FIG. 3 is a cross-sectional view through FIG. 2 along lines 3—3.

The two rotatable cleaning brushes 21 and 22 can best be seen by reference to FIG. 3 wherein the brushes are shown mounted vertically in the mounting framework 25 by two shafts 26 that pass through bushings 27 in members 28 to terminate respectively in a right and left sprocket or gear 19 and 20 at the upper end thereof and chain drive 17 contacts these gears as shown in FIG. 2 to effect counter-rotation thereof. It should be noted from FIG. 3 that the floating framework 25 in which the brushes are mounted within the housing 13 of the wheel-mounted carriage has a screw member 28 attached to the upper or top of the housing frame 13 and this bolt passes down through floating frame member 29 and has a spring 30 positioned thereon with a nut 31 that can be adjusted to vary or change the loading or tension applied to the brushes of the cleaning members as this adjustment determines the load or weight applied to the brushes and effects their contact with the floor. Floating frame member 25 is connected to the axle 32 of the drive wheels 14 by means of the pair of angle irons 51 which allows the front end of the sweeper assembly to be free of the front weight of the carriage except as it is applied by the spring 30.

Figure 4:
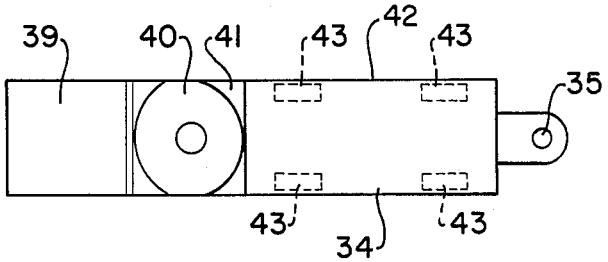
FIG. 4 is a plan view through the top of the so-called flipper means for attaching carts to the conveyor chain.

Referring back to FIG. 2, it should be noted that in the front and rear of the housing 13 is a bumper 33 to absorb the shock as the wheel carriage comes upon a cart that has been placed on the line that has not engaged the drive or pulling means 34 such as that shown in FIG. 4 and known as the flipper means.

Figure 5:
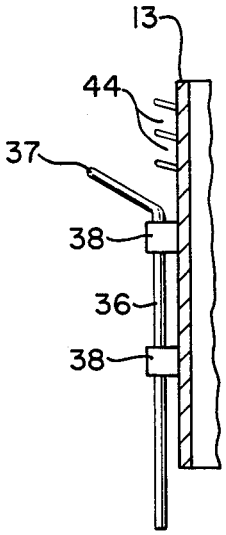
FIG. 5 is a vertical view through 5—5 of FIG. 2 of the pin assembly for attaching the sweeper to the conveyor.

Referring to FIG. 5, the nature of the pin assembly for attaching the wheel-mounted carriage to the flipper 34 with hole 35 for attachment to the chain (not shown) is shown in more detail, where the pin 36 having a handle 37 thereon is shown mounted slidably in two sliding flanges or rings attached to the two ring members 38 vertically aligned and attached to the front of the main housing 13 of the wheel-mounted carriage and having sufficient strength that it will be able to push or pull the cart. When a workman desires to attach the cart to the line, he takes the handle on the pin and raises the pin up and pushes the cart over the conveying chain and then lowers the chain down through the guide or opening in the floor and it rests on this until the attaching means, such as the flipper 4 of FIG. 4, comes up which has a tongue-like inclined plane 39 that slowly lifts this as it slides up the inclined surface and drops over into the hole 40 shown by the circle and comes to rest against the shoulder 41 of the main flipper carriage 42 having two pair of wheels 43 and thus is able to push the wheel-mounted carriage along the conveyor line as it would any other cart. Usually the pin and the handle has sufficient weight that there is no likelihood of it coming disengaged, and it stays in place simply by the force of gravity.

Referring again to FIG. 2, it will be seen that the chain 18 that passes around the drive gear or sprocket 17 passes on to the inside of the right hand gear 19 attached to the drive shaft of the right cleaning brush and as it passes around the inside of the gear of the right drive brush, it then passes around a small auxiliary gear 45 mounted on cross-brackets as shown in FIG. 2 and then passes over and around the outside of the gear 20 of the left brush and thus this training of the chain or belt effects counter-rotation of the two brushes relative each other as the carriage moves along the path of track 10, the counter- rotation of the brushes effectively sweeps the debris away from the critical area, viz., the area between the drive wheels 14 and the place where the conveyor chain is moving along the path 10.

It should be noted that the cart preferably has a pair of small rotatable wheels 46 attached swivelly at the front end of the housing in the position shown by the numeral 46 of FIG. 2. These wheels swivel as they rotate and thus facilitate the cart tracking around curves as it goes along the track.

While in accordance with the patent statutes, a preferred embodiment and best mode has been set forth in detail, the scope of the invention is limited by the scope of the attached claims.

What is claimed is:

1. An apparatus for cleaning the path of an endless conveyor for carts associated with the floor of a storage area, comprising:

a wheel mounted carriage attachable to said conveyor and containing a pair of counter rotatable cleaning brushes, a pair of drive wheels and a means to attach and detach the carriage to the conveyor, said cleaning brushes being mounted within said carriage essentially horizontally and being adjustably loaded by an adjustable load means to contact the floor, said pair of drive wheels being rotated by movement of the carriage to turn a means connected to a means to rotate said brushes counter to each other.

2. The apparatus of claim 1 wherein the counter rotatable cleaning brushes are mounted on a vertical drive shaft within said carriage.

3. The apparatus of claim 1 wherein the brushes are connected operatively to gears and the means to rotate said brushes passes around said gears on opposite sides of said gears to rotate said brushes counter to each other.

* * * * *